US009310172B2

(12) United States Patent
Zussman

(10) Patent No.: US 9,310,172 B2
(45) Date of Patent: Apr. 12, 2016

(54) WARHEAD

(71) Applicant: ISRAEL AEROSPACE INDUSTRIES LTD., Lod (IL)

(72) Inventor: Boaz Zussman, Sitriya (IL)

(73) Assignee: ISRAEL AEROSPACE INDUSTRIES LTD., Lod (IL)

( * ) Notice: Subject to any disclaimer, the term of this patent is extended or adjusted under 35 U.S.C. 154(b) by 0 days.

(21) Appl. No.: 14/441,261

(22) PCT Filed: Nov. 6, 2013

(86) PCT No.: PCT/IL2013/050912

§ 371 (c)(1),
(2) Date: May 7, 2015

(87) PCT Pub. No.: WO2014/072973

PCT Pub. Date: May 15, 2014

(65) Prior Publication Data

US 2015/0300794 A1 Oct. 22, 2015

(30) Foreign Application Priority Data

Nov. 12, 2012 (IL) ..... 222989

(51) Int. Cl.
*F42B 5/24* (2006.01)
*F42B 12/24* (2006.01)
(Continued)

(52) U.S. Cl.
CPC ..... *F42B 12/24* (2013.01); *F42C 19/0842* (2013.01); *F42C 19/095* (2013.01)

(58) Field of Classification Search
CPC ..... F42B 12/24; F42C 19/0842; F42C 19/095
USPC ..... 102/501, 389, 506, 491–497
See application file for complete search history.

(56) References Cited

U.S. PATENT DOCUMENTS 3,820,461 A * 6/1974 Silvia ..... F42B 1/00 102/305
3,877,376 A * 4/1975 Kupelian ..... F42C 19/095 102/211

(Continued)

FOREIGN PATENT DOCUMENTS

EP 2194354 6/2010
FR 2620215 3/1989

(Continued)

OTHER PUBLICATIONS

International Search Report and Written Opinion from International Application No. PCT/IL2013/050912 dated Dec. 31, 2013.

*Primary Examiner* — Michelle R Clement
(74) *Attorney, Agent, or Firm* — Dorsey & Whitney LLP

(57) ABSTRACT

A warhead configured for being mounted in a missile for hitting a target, the warhead comprising: a shell having a rotational symmetry about a longitudinal axis; a shell effective sector extending along said axis, with first and second pluralities of weakenings in said shell, each extending along and having respective first and second orientations relative to said longitudinal axis, such that upon exertion of an explosion force on the weakenings from a corresponding first or second direction, respective first or second explosion fragments are generated; and a first surface and a second surface, each extending along the longitudinal axis, and defining, together with said shell effective section, a cavity for accommodating an explosive charge; each of said surfaces being oriented so that upon initiation of detonation of the explosive charge adjacent to said first or said surface, shock waves propagating therefrom are directed towards the respective first or second plurality of weakenings in said respective first or second direction, so as to exert said explosion force thereon, thereby generating said first or second explosion fragments, respectively.

20 Claims, 4 Drawing Sheets

(51) Int. Cl.
*F42C 19/08* (2006.01)
*F42C 19/095* (2006.01)

(56) References Cited

U.S. PATENT DOCUMENTS 3,949,674 A * 4/1976 Talley ..... F42B 12/60 102/476
3,960,085 A * 6/1976 Abernathy ..... F42B 12/22 102/492
4,026,213 A * 5/1977 Kempton ..... F42C 19/095 102/475
4,312,247 A 1/1982 Silvestri
4,312,274 A * 1/1982 Zernow ..... F42B 12/22 102/493
H238 H * 3/1987 Adams ..... F42B 12/28 102/493
4,648,323 A * 3/1987 Lawther ..... F42B 12/32 102/495
4,655,139 A * 4/1987 Wilhelm ..... F42C 19/095 102/309
4,658,727 A * 4/1987 Wilhelm ..... F42C 19/095 102/492
4,662,281 A * 5/1987 Wilhelm ..... F42C 19/095 102/493
4,664,035 A * 5/1987 Osofsky ..... F42B 12/22 102/493
4,745,864 A * 5/1988 Craddock ..... F42B 12/22 102/491
4,823,701 A * 4/1989 Wilhelm ..... F41H 11/02 102/200
4,982,668 A * 1/1991 Bender ..... F42B 12/32 102/495
H1048 H * 5/1992 Wilson ..... F42B 12/32 102/364
5,131,329 A * 7/1992 Lips ..... F42B 12/44 102/364
5,313,890 A * 5/1994 Cuadros ..... F42B 12/32 102/393
5,801,323 A * 9/1998 Kerdraon ..... F42B 12/14 102/476
6,484,642 B1 * 11/2002 Kuhns ..... F42B 12/24 102/493
6,619,210 B1 * 9/2003 Spivak ..... F42B 12/10 102/475
6,910,423 B2 * 6/2005 Lloyd ..... F42B 12/58 102/476
6,920,827 B2 7/2005 Llyod
6,931,994 B2 * 8/2005 Lloyd ..... F42B 12/205 102/489
6,966,265 B2 * 11/2005 Ronn ..... F42B 12/32 102/389
6,973,878 B2 * 12/2005 Lloyd ..... F41H 11/02 102/475
7,040,235 B1 * 5/2006 Lloyd ..... F42B 12/64 102/489
7,066,093 B2 * 6/2006 Ronn ..... F42B 12/32 102/489
7,127,995 B2 * 10/2006 Ronn ..... F42B 12/22 102/506
7,143,698 B2 * 12/2006 Lloyd ..... F42B 12/205 102/489
7,621,222 B2 * 11/2009 Lloyd ..... F42B 12/24 102/497
7,717,042 B2 * 5/2010 Lloyd ..... F42B 12/56 102/489
7,743,707 B1 * 6/2010 Melin ..... F42C 19/0842 102/493
7,886,667 B1 * 2/2011 Baker ..... F42B 12/22 102/481
8,061,275 B1 * 11/2011 Gold ..... F42B 12/22 102/493
8,127,686 B2 * 3/2012 Lloyd ..... F42B 12/06 102/475
8,272,330 B1 * 9/2012 Gold ..... F42B 1/028 102/475
8,276,520 B1 * 10/2012 Fong ..... F42B 12/22 102/491
8,418,623 B2 * 4/2013 Lloyd ..... F42C 19/095 102/497
8,522,685 B1 * 9/2013 Gold ..... F42B 12/28 102/475
8,627,771 B1 * 1/2014 Gold ..... F42B 12/22 102/494
8,943,971 B1 * 2/2015 Sherlock ..... F42B 12/207 102/478
8,955,443 B1 * 2/2015 Miller ..... F42B 12/10 102/331
2003/0164108 A1 * 9/2003 Ronn ..... F42B 12/32 102/473
2003/0164109 A1 * 9/2003 Spivak ..... F42B 12/204 102/475
2004/0089185 A1 * 5/2004 Ronn ..... F42B 12/32 102/494
2012/0186482 A1 * 7/2012 Lloyd ..... F42B 12/60 102/495
2012/0291654 A1 * 11/2012 Wilson ..... F42B 12/32 102/492
2014/0182474 A1 * 7/2014 Dunaway ..... F42B 12/24 102/374
2014/0230682 A1 * 8/2014 Bonnstetter ..... F42B 12/24 102/492
2015/0300794 A1 * 10/2015 Zussman ..... F42B 12/24 102/501

FOREIGN PATENT DOCUMENTS

IL WO 2015102001 A1 * 7/2015 ..... F42B 12/22
JP 5187799 7/1993

* cited by examiner

WARHEAD

TECHNICAL FIELD

This invention relates to warheads, and particularly to fragmentation warheads which can be controlled for generating more than one size of explosion fragments.

BACKGROUND DESCRIPTION

Warheads may be directed against a wide spectrum of targets. There are soft targets which can include personnel or aircraft, and there are hard targets which may include anti-aircraft gun emplacements, missile warheads, tanks, etc. Between these two extremes, there are a multitude of targets.

One of the factors determining whether a particular warhead will be effective against a particular target is the size of the fragments produced upon detonation of the explosive within the warhead. In general, the softer the target, the smaller the fragments can be.

Warhead fragment size can be predetermined. This has been done, for example, by pre-grooving the interior surface of the warhead casing. When the casing alone is grooved, the casing groove pattern determines the fragment size.

One example of a reference that discloses a warhead which can generate different sizes of explosive fragments is U.S. Pat. No. 4,312,274. Another example of such a reference is U.S. Pat. No. 7,743,707.

SUMMARY OF THE PRESENTLY DISCLOSED SUBJECT MATTER

The presently disclosed subject matter provides a warhead which is configured to generate more than one type of explosion fragments, and to direct them towards a target. The term 'type of explosion fragments' relates to explosion fragments having a characterizing parameter such as size, or mass.

In accordance with one aspect of the presently disclosed subject matter, there is provided a warhead configured for being mounted in a missile for hitting a target. The warhead comprises:

a shell having a rotational symmetry about a longitudinal axis, a shell effective sector extending along said axis, with first and second pluralities of weakenings in the shell, each extending along and having respective first and second orientations relative to the longitudinal axis, such that upon exertion of an explosion force on the weakenings from a corresponding first or second direction, respective first or second explosion fragments are generated; and a first surface and a second surface, each extending along the longitudinal axis, and defining, together with said shell effective section, a cavity for accommodating an explosive charge; each of said surfaces being oriented so that upon initiation of detonation of the explosive charge adjacent to said first or said surface, shock waves propagating therefrom are directed towards the respective first or second plurality of weakenings in the respective first or second direction, so as to exert the explosion force thereon, thereby generating the first or second explosion fragments, respectively.

Each of the first and second surfaces can be associated with a respective first and second detonator configured to initiate the detonation of the explosive charge.

The warhead can comprise a selection mechanism configured for selecting one of the first and second detonators for initiating detonation of the explosive charge, for generating the first or second explosion fragments, respectively.

The selection of the first or the second detonators can be performed in accordance with the type of the target to be hit by corresponding first or second explosion fragments.

The first explosion fragments can be configured to effectively hit hard targets, and the second explosion fragments can be configured to effectively hit soft targets.

The missile can comprise a rolling mechanism configured for controlling the rolling of the missile and the warhead mounted therein. The rolling mechanism can be configured to be synchronized with the detonation of the explosive charge, such that upon generation of first or second explosion fragments, a corresponding portion of the shell effective sector that is corresponding to the first or the second shock wave is directed towards the target by the rolling mechanism.

The selection mechanism can be operative in conjunction with the orienting mechanism, so as to synchronize the detonation of the explosive charge with the rolling of the missile and the warhead mounted therein with respect to the target.

The selection mechanism and the rolling mechanism can be configured to communicate with a controller which coordinates the operation thereof.

The shell effective sector can have a third plurality of weakenings, each of which extends on a surface being perpendicular to the longitudinal axis, such that upon exertion of the explosion force on the first or the second plurality of weakening, the explosion force is exerted on the third plurality of weakenings, and the first or second explosion fragments are generated, respectively.

At least one of the first, second, and third plurality of weakening can be characterized by a corresponding first, second, and third pattern associated with the dimensions of the explosion fragments.

The pattern can corresponding the equal spacing between the weakening of each of the first, second and third plurality of weakenings.

The weakenings can be grooves formed within the shell.

The first and second surfaces can be deflection plates which are configured to direct propagation of the shock waves in the first and second directions, respectively.

The shell can be characterized by a cylinder-like shape, and the longitudinal axis is the central axis thereof.

The first and second surfaces can be disposed between the longitudinal axis and the shell.

The first and the second surfaces can be angled therebetween at an angle of less than 180°.

In accordance with another aspect of the presently disclosed subject matter, there is provided a missile comprising a warhead, as detailed above.

In accordance with another aspect of the presently disclosed subject matter, there is provided a method for operating a warhead configured for being mounted in a missile for hitting a target. The method comprises:

a. providing a warhead for hitting a target, comprising: a shell having a rotational symmetry about a longitudinal axis; a shell effective sector extending along the axis, with first and second pluralities of weakenings in the shell, each extending along and having respective first and second orientations relative to the longitudinal axis, such that upon exertion of an explosion force on the weakenings from a corresponding first or second direction, respective first or second explosion fragments are generated; a first surface and a second surface, each extending along the longitudinal axis, and defining, together with said shell effective section, a cavity for accommodating an explosive charge; each of the first and second surfaces is associated with a respective first and second detonator configured to initiate the detonation of the explosive charge; each of the surfaces being oriented so that upon initiation of detonation of the explosive charge by said first or second detonator, shock waves propagating therefrom are directed towards the respective first or second plurality of weakenings in the respective first or second direction, so as to exert said explosion force thereon, thereby generating said first or second explosion fragments, respectively; and a selection mechanism.

b. selecting, by the selection mechanism, one of the first and second detonators for initiating detonation of the explosive charge;

c. detonating the selected first or second detonator, thereby generating shock waves propagating from corresponding first or second surface of the selected detonator towards the first or second plurality of weakenings, thereby generating said first or second explosion fragments, respectively.

The step of selecting one of the first and second detonators can be performed in accordance with the type of the target to be hit by corresponding first or second explosion fragments.

The method can further include steps of: providing the warhead with a rolling mechanism for controlling the rolling of the warhead; and rolling the warhead via the rolling mechanism so as to turn at least a portion of the shell effective sector towards the target such that the respective first or second direction of the shock waves is at least partially directed towards the target.

The rolling of the warhead via the rolling mechanism can be performed by controlling the rolling of the missile on which the warhead is mounted.

The method can further comprise a step of operating the selection mechanism in conjunction with the orienting mechanism, so that the warhead is rolled in accordance with the first or second detonator selected to be detonated, and their respectively generated shock waves the direction of which is directed towards the target.

BRIEF DESCRIPTION OF THE DRAWINGS

In order to understand the invention and to see how it can be carried out in practice, embodiments will now be described, by way of non-limiting examples only, with reference to the accompanying drawings, in which.

DETAILED DESCRIPTION OF EMBODIMENTS

Figure 1:
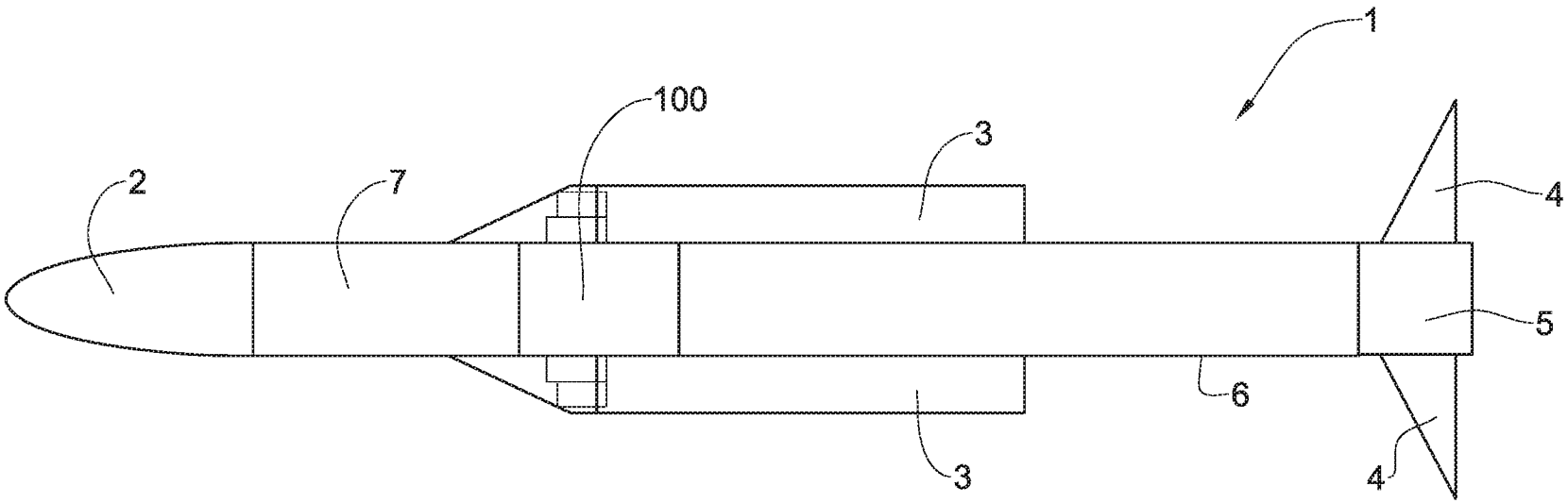
FIG. 1 is a perspective schematic illustration of a missile with a warhead mounted therein, in accordance with one aspect of the presently disclosed subject matter.

Reference is first made to FIG. 1 of drawings, in which an example of a missile 1 is illustrated. The missile 1 is formed of a body 6 with a warhead 100, in accordance with one aspect of the presently disclosed subject matter, mounted thereon, a seeker section 2 disposed at the proximal end of the missile 1, an electronic section 7, wings 3, and a steering section 5 including fins 4. The fins 4 constitute part of a rolling mechanism configured for controlling the rolling of the missile and the warhead 100 mounted therein. The missile 1 further includes a controlling mechanism (not shown), responsible for controlling the operation thereof, and particularly, controlling the detonation of the warhead 100, and the flight direction and rolling of the missile 1. During operation, the controlling mechanism of missile 1 processes data and information regarding the real-time location of the missile, and data related to the target to be hit, and provides corresponding instructions to the missile's parts.

The warhead 100 is related to the type of directional warheads, according to which only a section of the warhead includes an explosive charge, and this section is the one that is directed towards a target during an detonation of the explosive charge. This section can be a longitudinal slice which is proximal to a specific section of the warhead's wall.

Figure 2A:
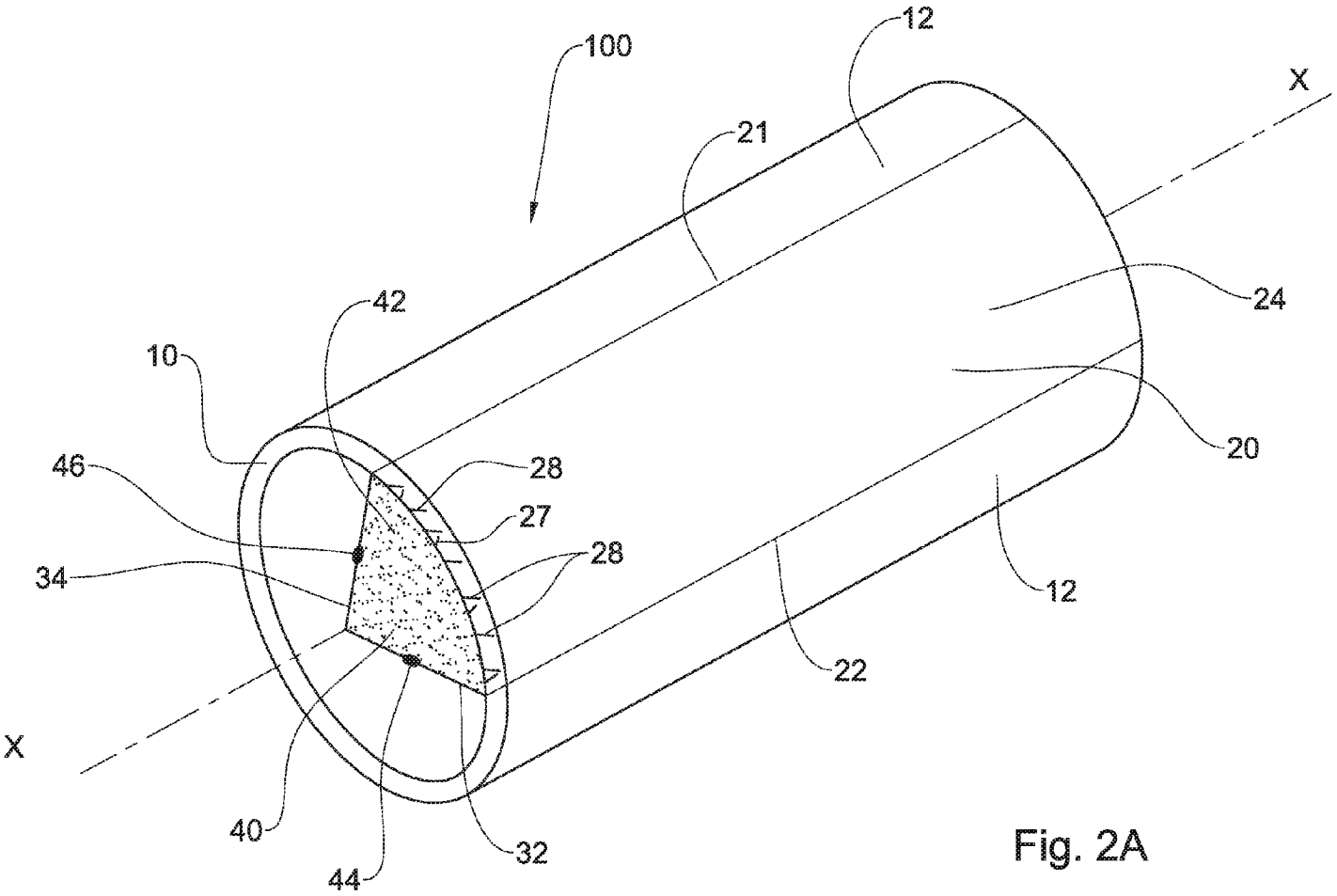
FIG. 2A is a perspective view of a warhead in accordance with one aspect of the presently disclosed subject matter.
Figure 2B:
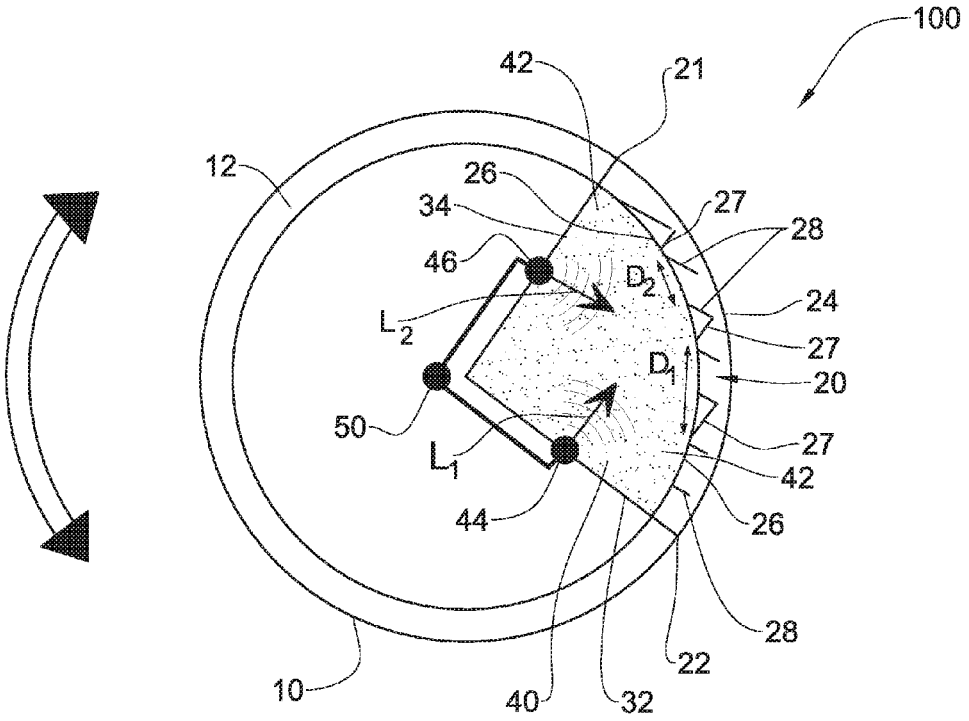
FIG. 2B is a cross-sectional view of the warhead of FIG. 2A in accordance with one aspect of the presently disclosed subject matter.

Reference is first made to FIGS. 2A and 2B which schematically illustrate a warhead 100, in accordance with one example of the presently disclosed subject matter. The warhead 100 is intended for hitting the target by being exploded in proximity thereto, and generation of explosion fragments which are directed towards the target. The warhead 100 is configured for generating two types of explosion fragments (not shown), each characterized by a different typical size, for hitting a different corresponding type of a target (e.g., soft target, hard target). Each type of explosion fragments is intended to harm its corresponding type of a target in an effective manner. The explosion fragments are generated by the warhead 100, such that at least a majority thereof is directed towards the target. The structure and the mechanism of operation of the warhead 100, which are detailed below, are intended not only to suit the type (i.e., the size) of the explosion fragments to the type of the target to be hit, but also to direct these fragments towards the target with a minimal waste of explosion fragments and an explosion charge generating them. The warhead 100 generates target-dependent explosion fragments the majority of which is intended to hit the target by being straightly directed thereto.

The warhead 100 has a cylindrical shape, and is constructed of a shell 10 having a rotational symmetry about a longitudinal axis X. The shell 10 includes a shell effective sector 20 which extends along the axis X, and constitutes a portion of the shell 10. As shown in the above FIGS. 2A and 2B, the shell effective sector 20 has a first border line 21, a second border line 22, each of which is parallel to the axis X and is connected to a different respective edge of portion 12 of the shell 10.

The warhead 100 further includes a first surface 32 and a second surface 34, each extending along the axis X, and defining, together with the shell effective section 20, a cavity 40 which accommodates an explosive charge 42. The first and the second surfaces 32 and 34 are angled therebetween. The first and the second surfaces 32 and 34 are deflection plates which are configured to direct propagation of shock waves from each one of them towards the shell effective section 20.

The first and the second surfaces 32 and 34 include first and second detonators 44 and 46, respectively, each configured to initiate detonation of the explosive charge 42, in accordance with the type of the explosion fragments to be generated. The first and the second detonators 44 and 46 are extending along their corresponding surfaces 32 and 34 parallel to the axis X.

Figure 3:
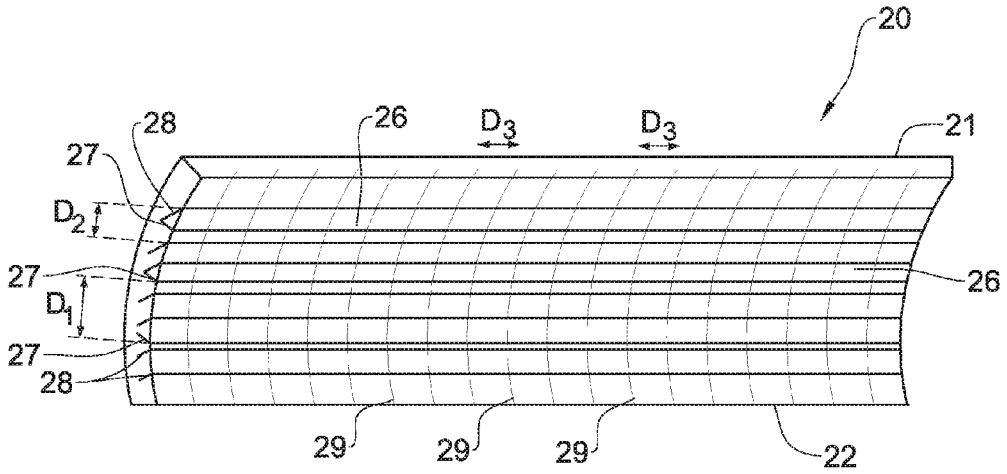
FIG. 3 is a perspective view of a shell effective sector of the warhead of FIG. 2A.

The shell effective sector 20 has also an outer face 24 and an inner face 26. As it is clearly shown in FIG. 3, the inner face 26 has a first plurality of weakening, in form of first grooves 27, a second plurality of weakening, in form of second grooves 28, and a third plurality of weakening, in form of third grooves 29 (shown in FIG. 3). The first, the second and the third grooves 27, 28 and 29 are formed within the inner face 26, and are facing the explosive charge 42. The first grooves 27 and the second grooves 28 are extending along the axis X, and having respective first and second orientations relative to the axis X. The first and the second orientations are inclined at different angles with respect to a radial surface defined between the location of the groove and the axis X. The third grooves 29 extend along surfaces which are perpendicular to the axis X, and are not inclined with respect to these surfaces. The first grooves 27 are equally spaced therebetween, with a distance $D_1$, the second grooves 28 are equally spaced therebetween, with a distance $D_2$, and the third grooves 29 are equally space therebetween, with a distance $D_3$.

Reference is now made back to FIG. 2B, in which the inclination of the first grooves 27 and the second grooved 28 is clearly shown. The inclination of the first and the second grooves 27 and 28 is such that upon exertion of an explosion force on the first groves 27 together with the third grooves 29 or the second grooves 28 together with the third grooves 29, from a corresponding first direction $L_1$ or a second direction $L_2$ (shown in FIG. 2A), first or second explosion fragments are generated, respectively. For generating this explosion force, the surfaces 32 and 34 are oriented with respect to the first and the second grooves 27 and 28 such that upon detonation of the explosive charge by the respective first and second detonators 44 and 46, respective shock waves having a direction $L_1$ or $L_2$ are generated as a result of the explosion of the explosion charge 42.

When the first detonator 44 is detonated, a shockwave having the direction $L_1$ propagates from the first surface 32 towards the shell effective sector 20, and particularly towards the first plurality of grooves 27. This shock wave scores the shell effective sector 20 in the first grooves 27 and the third grooves 29, and as result of that, first explosion fragments are generated.

When the second detonator 46 is detonated, a shockwave having the direction $L_2$ propagates from the second surface 34 towards the shell effective sector 20, and particularly towards the second plurality of grooves 28. This shock wave scores the shell effective sector 20 in the second grooves 28 and the third grooves 29, and as result of that, second explosion fragments are generated.

The warhead 100 includes a selection mechanism 50 configured for selecting the detonator to be detonated, in accordance with the type of the explosion fragments to be generation. As shown in FIG. 2B, the selection mechanism 50 is connected to the first and second detonators 44 and 46, and in accordance with instructions to detonate the first or the second detonator, the selection mechanism initiates a respective explosion chain. The selection mechanism is controllable by the controlling mechanism of the missile 1, and its selection of the first or the second detonators to be detonated is performed in accordance with the type of the target to be hit by corresponding first or second explosion fragments.

As explained above, the warhead 100 is characterized by an ability to generate two types of explosion fragments, in accordance with the type of the target to be hit, wherein each type of the explosion fragments is characterized by a different typical size, as follows:

- a first type of explosion fragments: large explosion fragments having a length of about $D_3$, and a width of about $D_1$. These explosion fragments are configured to effectively hit hard targets, i.e., fragments which are configured to penetrate and damage objects such as missile warheads; and
- a second type of explosion fragments: small explosion fragments having a length of about $D_3$, and a width of about $D_2$. These explosion fragments are configured to effectively hit soft targets, i.e., aircrafts.

As shown in FIGS. 2A and 2B, the chamber 40 is characterized by a structure according to which, since the warhead in related to the type of directional warheads, only one section of the whole periphery of the shell 10 includes an explosive charge. The volume of the chamber 40 out of the whole volume of the shell 10, is about ⅓. This structure is different from other known structures of warheads, such as the one disclosed in U.S. Pat. No. 7,743,707, according to which the explosive charge is accommodated in the whole periphery of the warhead and occupies substantially the entire volume thereof. In the warhead of this reference there is a waste of explosive charge, because only part of the explosion fragments of this warhead hit the target, and the majority of the explosion fragments does not hit the target, and thereby are wasted. The structure of chamber 40, allows saving weight of an explosive charge and weight of warhead fragments, and thereby reducing the weight of the warhead 100, and of the whole missile 1.

For effectively operating the warhead 100, during explosion of the explosive charge, the chamber 40 and its shell effective sector 20 have to be brought substantially in front of the target. In addition to that, since the first and the second explosion fragments generated during explosion are directed to different directions (generally along L1 and L2, respectively), a different portion of the shell effective sector 20 has to be brought in front of the target. As indicated with reference to FIG. 1, the missile 1 includes fins 4 which constitute part of a rolling mechanism configured for controlling the rolling of the missile 1 and its warhead 100 with respect to the target. The rolling mechanism is configured to be synchronized and operated in conjunction with the selection mechanism, so that at the moment of explosion, a corresponding portion of the shell effective sector 20 is brought in front of the target, in accordance with the detonator being selected (i.e., the first or the second detonator) for generating the explosion fragments, and respectively the direction from which the generated explosion fragments arrive towards the target. It should be indicated, the as a result of the explosion, the whole shell effective sector 20 is exploded.

The selection mechanism and the rolling mechanism are controllable by the controlling mechanism of the missile, which coordinates the operation thereof.

Figure 4A:
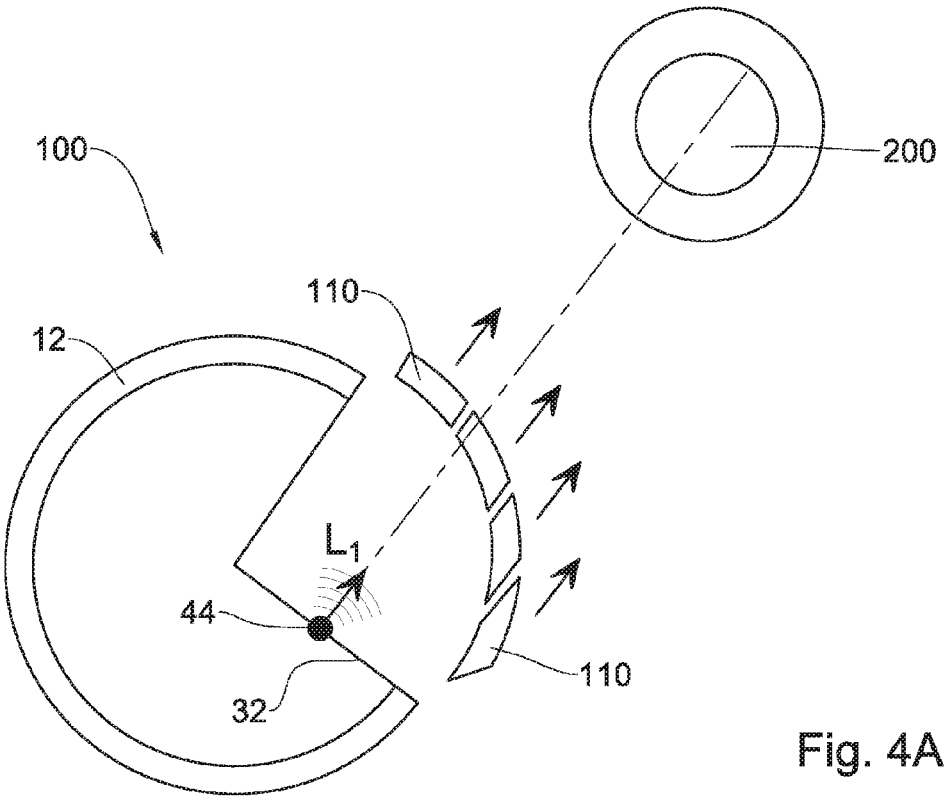
FIG. 4A is a cross-sectional view of the warhead of FIG. 2A hitting a target.
Figure 4B:
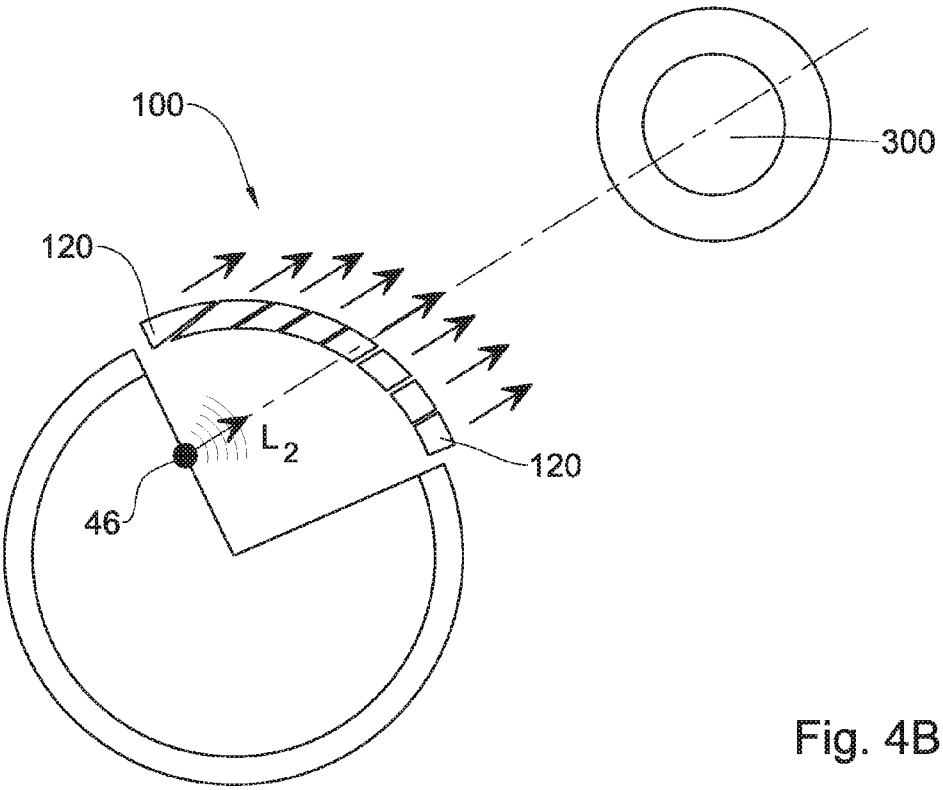
FIG. 4B is a cross-sectional view of the warhead of FIG. 2A hitting a target.

Reference is now made to FIGS. 4A and 4B, which illustrate two positions of the warhead 100 with respect to two different types of targets 200 and 300, respectively. These figures schematically illustrate how the missile 1 and its warhead 100 can be applied for hitting two types of targets by being able to generate two types of explosion fragments, and rolling the warhead with respect to the target accordingly.

FIG. 4A illustrates a moment of explosion, in which a hard target 200 is attacked by the missile 1 and its warhead 100. In this case, the selection mechanism has received information from the controlling mechanism of the missile 1 that the target to be attacked is a hard target, and therefore the first detonator 44 which generated relatively large first explosion fragments 110 has to be detonated. In addition, the rolling mechanism of the missile has received the exact location of the target 200 with respect to the missile 1, and has been instructed the missile to roll so as to direct a respective position of the shell effective sector 20 in front of the target 200. By this positioning of the shell effective sector 20 with respect to the hard target 200, the majority of the first explosion fragments 110 does not miss this target, and effectively hit it. The first explosion fragments 110 that are generated as a result of the detonation of the first detonator 44, and the consequential explosion of the explosive charge 42, are generated by the shock wave that propagates in the direction $L_1$, and by fraction the shell effective sector 20 in the first and the third grooves 27 and 29. The dimension of the first explosion fragments 110 is determined by the distance $D_1$ between the first grooves 27 and the distance $D_3$ between the third grooves 29. Since the distance $D_1$ is relatively large, the first explosion fragments 110 are also relatively large.

FIG. 4B illustrates a moment of explosion, in which a soft target 300 is attacked by the missile 1 and its warhead 100. In this case, the selection mechanism has received information from the controlling mechanism of the missile 1 that the target to be attacked is a soft target, and therefore the second detonator 46 which generated relatively small second explosion fragments 120 has to be detonated. In addition, the rolling mechanism of the missile 1 has received the exact location of the target 200 with respect to the missile 1, and has been instructed to roll the missile so as to direct a respective position of the shell effective sector 20 in front of the target 300. By this positioning of the shell effective sector 20 with respect to the soft target 300, the second explosion fragments 120 do not miss the target 300, and effectively hit it. The second explosion fragments 120 that are generated as a result of the detonation of the second detonator 46, and the consequential explosion of the explosive charge 42, are generated by the shock wave that propagates in the direction $L_2$, and by fraction the shell effective sector 20 in the second and third grooves 28 and 29. The dimension of the second explosion fragments 120 are determined by the distance $D_2$ between the second grooves 28 and the distance $D_3$ between the third grooves 29. Since the distance $D_2$ is relatively small, the second explosion fragments 120 are also relatively small.

The invention claimed is:

1. A warhead configured for being mounted in a missile for hitting a target, the warhead comprising:

a shell having a rotational symmetry about a longitudinal axis;

a shell effective sector extending along said axis, with first and second pluralities of weakenings in said shell, each extending along and having respective first and second orientations relative to said longitudinal axis, such that upon exertion of an explosion force on the weakenings from a corresponding first or second direction, respective first or second explosion fragments are generated; and a first surface and a second surface, each extending along the longitudinal axis, and defining, together with said shell effective section, a cavity for accommodating an explosive charge; each of said first and second surfaces being oriented so that upon initiation of detonation of the explosive charge adjacent to said first surface or said second surface, shock waves propagating therefrom are directed towards the respective first or second plurality of weaknings in said respective first or second direction, so as to exert said explosion force thereon, thereby generating said first or second explosion fragments, respectively.

2. The warhead according to claim 1, wherein each of said first and second surfaces is associated with a respective first and second detonator configured to initiate the detonation of the explosive charge.

3. The warhead according to any claim 2, further comprising a selection mechanism configured for selecting one of said first and second detonators for initiating detonation of the explosive charge, for generating said first or second explosion fragments, respectively.

4. The warhead according to claim 3, wherein said selection of the first or the second detonators is performed in accordance with a type of the target to be hit by corresponding first or second explosion fragments.

5. The warhead according to claim 4, wherein said first explosion fragments are configured to effectively hit hard targets, and said second explosion fragments are configured to effectively hit soft targets.

6. The warhead according to claim 3, wherein said missile includes a rolling mechanism configured for controlling rolling of the missile and the warhead mounted therein, said rolling mechanism is configured to be synchronized with the detonation of the explosive charge, such that upon generation of first or second explosion fragments, a corresponding portion of the shell effective sector that is corresponding to the first or the second shock wave is directed towards said target by said rolling mechanism.

7. The warhead according to claim 6, wherein said selection mechanism is operative in conjunction with said orienting mechanism, so as to synchronize the detonation of the explosive charge with the rolling of the missile and the warhead mounted therein with respect to the target.

8. The warhead according to claim 7, wherein said selection mechanism and said rolling mechanism are configured to communicate with a controller which coordinates the operation thereof.

9. The warhead according to claim 1, wherein said shell effective sector has a third plurality of weakenings, each of which extends on a surface being generally perpendicular to said longitudinal axis, such that upon exertion of the explosion force on the first or the second plurality of weakening, said explosion force is exerted on said third plurality of weakenings, and said first or second explosion fragments are generated, respectively.

10. The warhead according to claim 9, wherein at least one of said first, second, or third plurality of weakening is characterized by a corresponding first, second, and third pattern associated with the dimensions of said explosion fragments.

11. The warhead according to claim 10, wherein said pattern is corresponding to the equal spacing between the weakening of each of said first, second and third plurality of weakenings.

12. The warhead according to claim 1, wherein said first and second surfaces are deflection plates which are configured to direct propagation of said shock waves in said first and second directions, respectively.

13. The warhead according to claim 1, wherein said shell is characterized by a cylinder-like shape, and said longitudinal axis is the central axis thereof.

14. The warhead according to claim 1, wherein said first and second surfaces are disposed between said longitudinal axis and said shell.

15. The warhead according to claim 1, wherein the first and the second surfaces are angled therebetween at an angle of less than 180°.

16. A missile including the warhead according to claim 1.

17. A method for operating a warhead configured for being mounted in a missile for hitting a target, comprising:

providing a warhead for hitting a target, the warhead comprising: a shell having a rotational symmetry about a longitudinal axis; a shell effective sector extending along said axis, with first and second pluralities of weakenings in said shell, each extending along and having respective first and second orientations relative to said longitudinal axis, such that upon exertion of an explosion force on the weakenings from a corresponding first or second direction, respective first or second explosion fragments are generated; a first surface and a second surface, each extending along the longitudinal axis, and defining, together with said shell effective section, a cavity for accommodating an explosive charge; each of said first and second surfaces is associated with a respective first and second detonator configured to initiate the detonation of the explosive charge; each of said surfaces being oriented so that upon initiation of detonation of the explosive charge by said first or second detonator, shock waves propagating therefrom are directed towards the respective first or second plurality of weaknings in said respective first or second direction, so as to exert said explosion force thereon, thereby generating said first or second explosion fragments, respectively; and a selection mechanism;

selecting, by said selection mechanism, one of said first or second detonators for initiating detonation of the explosive charge;

detonating the selected first or second detonator, thereby generating shock waves propagating from corresponding first or second surface of the selected detonator towards said first or second plurality of weakenings, thereby generating said first or second explosion fragments, respectively.

18. The method according to claim 17, wherein said selecting one of said first or second detonators is performed in accordance with a type of the target to be hit by corresponding first or second explosion fragments.

19. The method according to claim 17, further comprising:

providing said warhead with a rolling mechanism for controlling the rolling of the warhead; and rolling the warhead via said rolling mechanism so as to turn at least a portion of the shell effective sector towards said target such that the respective first or second direction of the shock waves is at least partially directed towards the target.

20. The method according to claim 17, further comprising operating said selection mechanism in conjunction with said orienting mechanism, so that the warhead is rolled in accordance with the first or second detonator selected to be detonated, and their respectively generated shock waves the direction of which is directed towards the target.

* * * * *